US008247675B2

(12) United States Patent
Griego

(10) Patent No.: US 8,247,675 B2
(45) Date of Patent: Aug. 21, 2012

(54) BRASS MUSICAL INSTRUMENTS WITH MODIFIABLE TONALITY

(75) Inventor: Christan Griego, Elkhorn, WI (US)

(73) Assignee: Getzen Company, Elkhorn, WI (US)

( * ) Notice: Subject to any disclaimer, the term of this patent is extended or adjusted under 35 U.S.C. 154(b) by 454 days.

(21) Appl. No.: 12/639,589

(22) Filed: Dec. 16, 2009

(65) Prior Publication Data

US 2010/0147134 A1 Jun. 17, 2010

Related U.S. Application Data

(60) Provisional application No. 61/201,949, filed on Dec. 17, 2008.

(51) Int. Cl.
*G10D 9/00* (2006.01)

(52) U.S. Cl. ..... 84/387 R

(58) Field of Classification Search ..... 84/387 R, 84/387 A, 388–396
See application file for complete search history.

(56) References Cited

U.S. PATENT DOCUMENTS

| | | | | |
|---|---|---|---|---|
| 1,021,890 | A | | 4/1912 | Riblet |
| 1,555,986 | A | | 10/1925 | Keefer et al. |
| 4,977,809 | A | * | 12/1990 | Staley, Jr. ..... 84/395 |
| 5,644,095 | A | | 7/1997 | Davidson |
| 5,965,832 | A | | 10/1999 | Davidson |
| 6,977,329 | B2 | | 12/2005 | Vans Evers |
| 7,335,831 | B2 | | 2/2008 | Laukat et al. |

OTHER PUBLICATIONS

Excerpts of International Search Report and Written Opinion. PCT/US09/06591. 4 pages Dated: Mar. 22, 2010.

* cited by examiner

*Primary Examiner* — Kimberly Lockett
(74) *Attorney, Agent, or Firm* — Jansson Shupe & Munger Ltd.

(57) ABSTRACT

In a brass musical instrument having two substantially parallel adjacent braces between portions of the instrument windpath tubing, the improvement comprising a cross-brace extending in planes substantially parallel to a plane of the parallel braces and having two opposed edges each with two spaced contact regions secured to a respective one of the parallel braces and a recessed region between the contact regions, thereby allowing elimination of other windpath bracing and providing a beneficial site for sound-modifying components.

23 Claims, 13 Drawing Sheets

BRASS MUSICAL INSTRUMENTS WITH MODIFIABLE TONALITY

RELATED APPLICATION

This application is based on U.S. Provisional Application 61/201,949 filed on Dec. 17, 2008.

FIELD OF THE INVENTION

This invention relates to musical instruments and, more specifically, to brass instruments and devices for windpath bracing thereof. The invention is also related to sound modification for brass instruments.

BACKGROUND OF THE INVENTION

The sound emanating from a brass musical instrument is affected by numerous physical parameters. As is well-known, such sound is much more than just the frequency of the fundamental note being played by the musician but also includes the resonances of the various parts of the instrument, all of which provide the "color" to the sound being produced by the musical instrument.

A brass instrument produces a musical note when the air column in the instrument is excited into resonance by the musician introducing air into the windpath through a mouthpiece. The process of sound formation is extremely complex and even includes the musculature of the musician and the instant muscle tone thereof. Among the physical parameters of the instrument which are important are the windpath tubing material and material thicknesses, the shape of the windpath, and the location and type of bracing used. Thus, bracing is an important element in the determination of the character of the resulting sound.

Musicians often characterize an instrument as having a certain "feel," and the feel of the instrument is affected by the resonances of the instrument. Changing the feel involves changing anything which affects the resonances of the instrument. Musicians would like to be able to change the feel and sound of an instrument depending on the type of music being played without the expense of having multiple instruments with different materials, shapes, bracing, etc. For example, early-period music requires a lighter, more transparent sound than more contemporary music, and thus there is a need for brass instruments which can produce many different types of sound simply by carrying out an adjustment of the instrument.

In the construction of brass musical instruments, the use of bracing is required for structural integrity while limiting the number of braces helps to keep stresses out of the instrument and also reduces manufacturing cost.

OBJECTS OF THE INVENTION

It is an object of the invention to provide a simple way to vary the sound of the instrument without the often extensive modifications required such as but not limited to changing the material used for the instrument itself, varying the shapes of the bell, varying the material thickness of the windpath tubing and/or bell, and so forth.

Another object of the inventive musical instrument is to provide a convenient, cost-effective location for the placement of a variety of sound-modifying components.

Another object of the present invention is to provide a brass musical instrument in which the number of windpath tubing braces may be reduced.

Yet another object of the invention is to provide an instrument which maintains or increases the structural integrity of the instrument while eliminating some bracing.

Yet another object of the invention is to provide an instrument on which the "feel" of the instrument can be easily modified.

Yet another object of the invention is to provide an instrument on which the "feel" of the instrument can be rapidly modified.

Yet another object of the invention is to provide an instrument on which the "feel" of the instrument can be modified to produce a wide variety of different results.

These and other objects of the invention will be apparent from the following descriptions and from the drawings.

SUMMARY OF THE INVENTION

The present invention is an improved brass musical instrument, such brass musical instrument having two substantially parallel adjacent braces between portions of the instrument windpath tubing, and the improvement comprises a cross-brace extending in planes substantially parallel to a plane of the parallel braces and having two opposed edges each with two spaced contact regions secured to a respective one of the parallel braces and a recessed region between the contact regions. Such improvement allows other windpath bracing to be eliminated and providing at least one site for securement of at least one sound-modifying component.

In some embodiments of the improved brass musical instrument, the cross-brace has at least one through-hole transverse to the planes of the cross-brace and each through-hole is adapted for receiving a sound-modifying component.

In other embodiments, the improved instrument further includes a sound-modifying component within a through-hole.

In preferred embodiments of the brass musical instrument, the cross-brace has opposed substantially flat faces extending in planes substantially parallel to a plane of the parallel braces with a plurality of the through-holes arranged therealong. In some of these embodiments, the sound-modifying component is adjustably received within the corresponding through-hole, thereby facilitating sound modification to a musician's preference. In other preferred embodiments, the sound-modifying component is a pillar.

In yet other preferred embodiments of the improved brass musical instrument, the pillar is adjustably received within the corresponding through-hole, thereby facilitating sound modification to a musician's preference, and in some of these highly-preferred embodiments, the through-hole and at least a portion of the pillar therein are threaded to facilitate adjustability. In some of these preferred embodiments, the threading provides an interference fit between the pillar and the through-hole.

In highly-preferred embodiments of the improved brass musical instrument, each of the contact and recessed regions of each opposed edge is in alignment with the corresponding region of the other opposed edge, and the cross-brace has opposed end regions each extending beyond a corresponding pair of contact regions. In some such embodiments, each end region has a pair of end-edges converging to a point region. Further, in some of these embodiments, the point regions are along a centerline of the cross-brace and are symmetrical to one another.

In yet other embodiments, the present invention is a cross-brace for bracing the windpath tubing of a brass musical instrument. The cross-brace comprises a unitary substantially flat metallic body having two opposed edges each with two spaced contact regions for non-removable attachment to a portion of the brass instrument and a recessed region between the contact regions, thereby providing at least one site for securement of at least one sound-modifying component.

In some embodiments of the invention, the cross-brace spans between portions of the windpath tubing, and some instruments include a pair of cross-braces.

In other embodiments of the improved brass musical instrument having windpath braces between portions of the instrument windpath tubing, the improvement includes at least one brace which is a unitary substantially flat metallic body having two edges with contact regions for non-removable attachment to a portion of the brass instrument and a region between the contact regions which provides at least one site for securement of at least one sound-modifying component. Some of the inventive instruments are trumpets, some of which may include a pair of cross-braces.

In some other embodiments of a brass musical instrument having windpath braces between portions of the instrument windpath tubing, at least one windpath brace is a sound-modifying brace which includes at least one through-hole for adjustable securement of a sound-modifying pillar, a pillar being adjustably secured in such through-holes. Some of these embodiments include a plurality of pillars, each secured in a respective through-hole.

The use of the term "brass" to describe a type of musical instrument does not, of course, limit the material out of which such instruments are made but rather indicates a category of musical instrument which includes but is not limited to trombones, trumpets, euphoniums, tubas, french horns, and the like.

The term "point region" as used herein refers to an end portion of a structure which has transverse dimensions (transverse to the direction pointing toward the end portion) which decreases toward the end portion. The point region may reduce in transverse dimension to a sharp point, to a rounded point, or to a variety of other such transverse-dimension-reducing shapes.

The term "pillar" as used herein refers to a rod-like structure which passes through or extends from the cross-brace and has a generally-constant cross-section. Pillars may have circular cross-sections but are not limited to such configurations. Further, pillars may be threaded or partially-threaded along the length thereof.

DETAILED DESCRIPTION OF PREFERRED EMBODIMENTS

Figure 1:
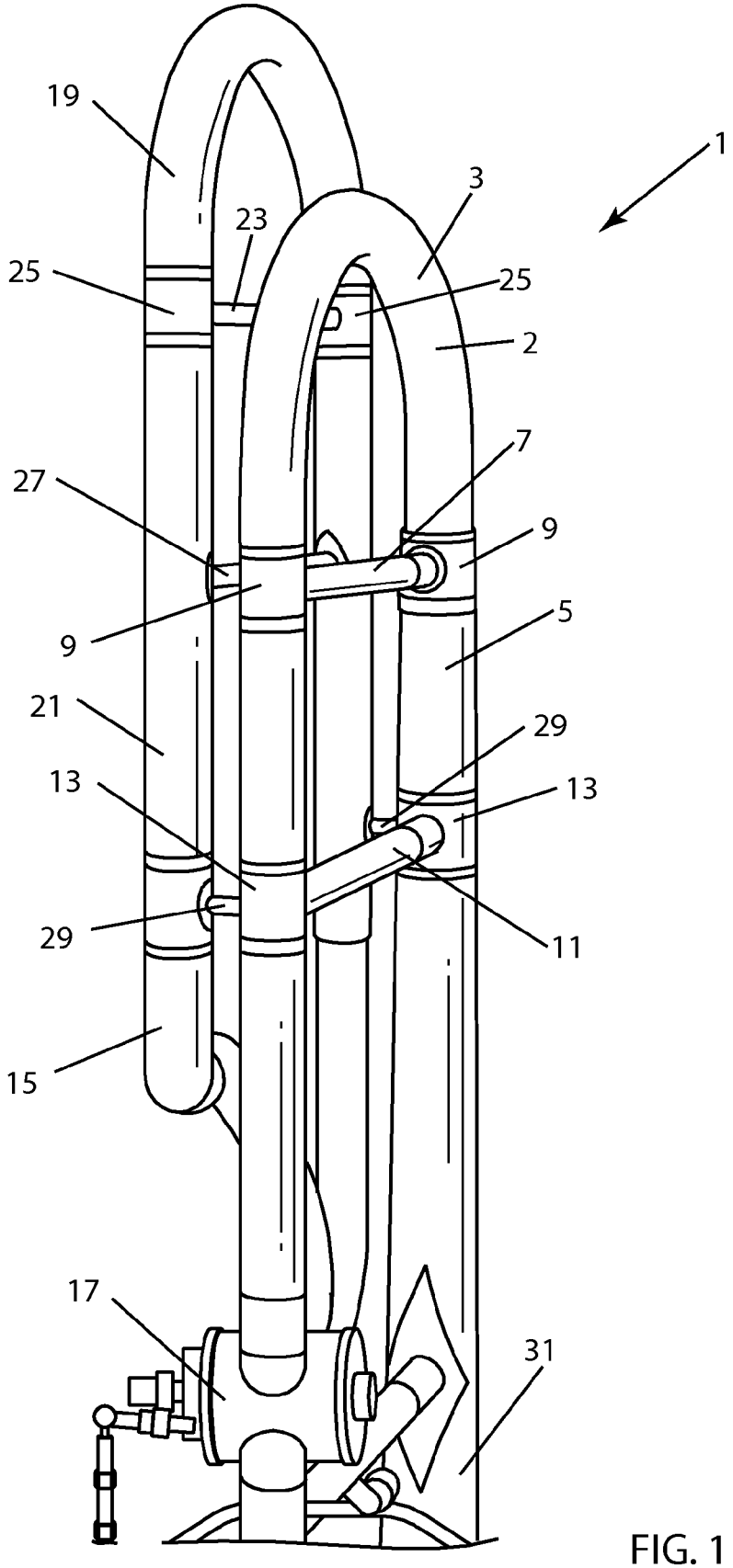
FIG. 1 is a perspective drawing of a prior art trombone (brass musical instrument).

FIG. 1 is a perspective drawing of an F valve section of a prior art tenor trombone 1, a brass musical instrument, and many of the elements of the instrument are identified in FIG. 1 since the inventive brass musical instrument of the present invention includes many of the elements of such instrument. Prior art trombone 1 of FIG. 1 includes a B-flat wrap 2 with a B-flat tuning slide 3 which slides within a tuning slide receiver 5 to enable the musician to finely adjust the pitch of trombone 1. B-flat tuning slide 3 includes a brace 7 attached to slide 3 with two ferrules 9, and tuning slide receiver 5 includes brace 11 attached to receiver 5 with two ferrules 13. Braces 9 and 11 provide structure to slide 3 and receiver 5, respectively.

Prior art trombone 1 also includes an F branch (or F wrap) 15 which is included (adds length) in the windpath of trombone 1 when a F rotor valve 17 is actuated. F branch 15 includes an F tuning slide 19 which slides within a tuning slide receiver 21 to enable the musician to finely adjust the pitch of trombone 1 in a fashion similar to that of B-flat slide 3. F tuning slide 19 includes a brace 23 attached to slide 19 with two ferrules 25, and tuning slide receiver 21 includes brace 27. Braces 23 and 27 provide structure to slide 19 and receiver 21, respectively.

Prior art trombone 1 also includes two braces 29 which provide a structural connection between B-flat tuning slide receiver 5 and F tuning slide receiver 21.

FIG. 1 shows only a very small portion of the bell 31 of trombone 1.

Figure 2:
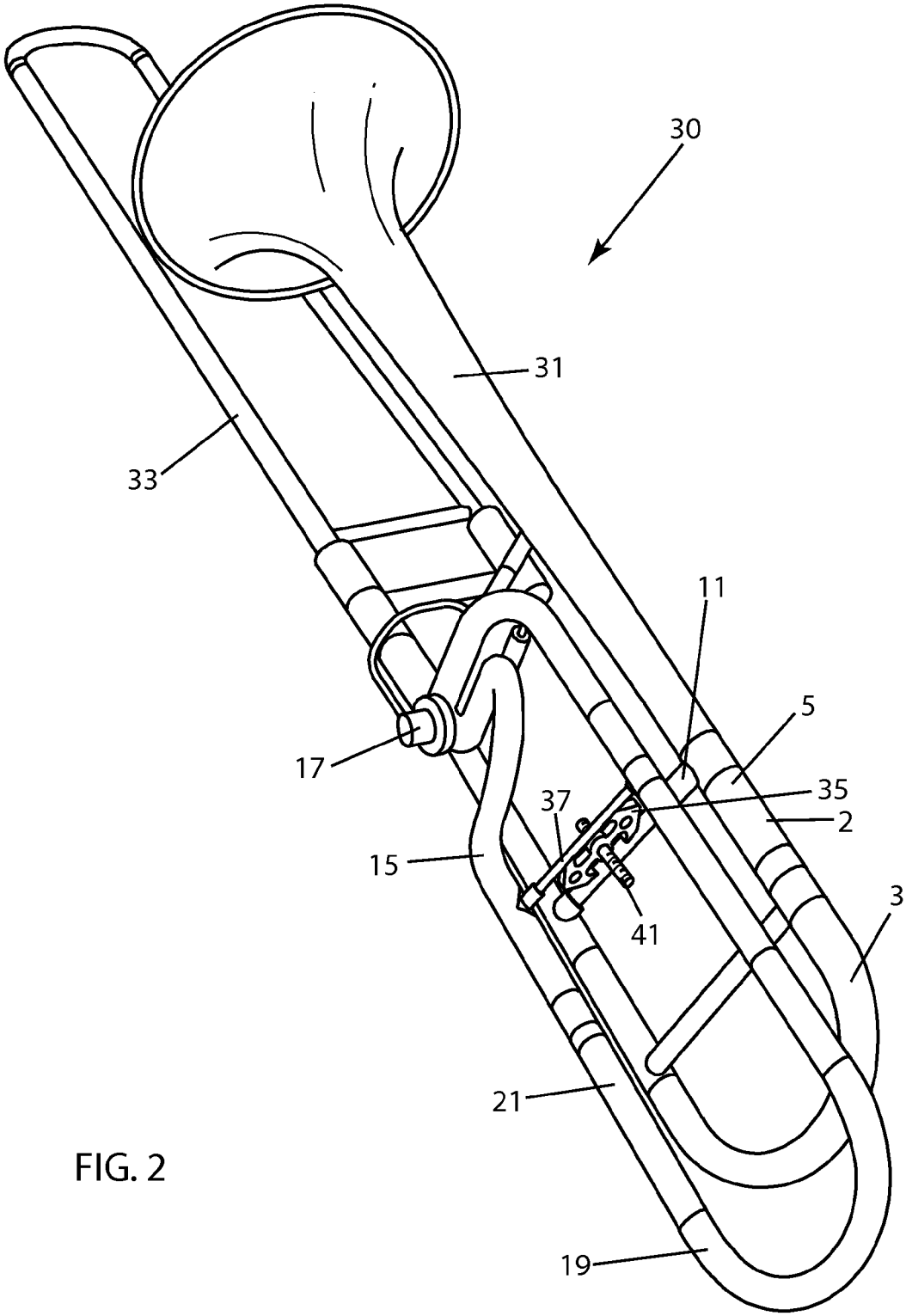
FIG. 2 is a perspective drawing of an embodiment of an improved musical instrument (trombone) with the mouthpiece removed.

FIG. 2 is a perspective drawing of an embodiment of an improved musical instrument (improved trombone 30) with the mouthpiece removed. (Components of trombone 30 which are similar to components of prior art trombone 1 have been given the same reference numbers as in the description of prior art trombone 1 in FIG. 1.) FIG. 2 shows the main telescopic slide 33 of trombone 30 by which the musician changes the length of the windpath tube in order to change the fundamental frequency (pitch) of the sound produced by trombone 30.

Improved trombone 30 includes a cross-brace 35 which is secured to two parallel braces 37 and 11. Brace 37 is within F wrap 15 of trombone 30, and brace 11 is within B-flat wrap 2 of trombone 30.

Figure 3:
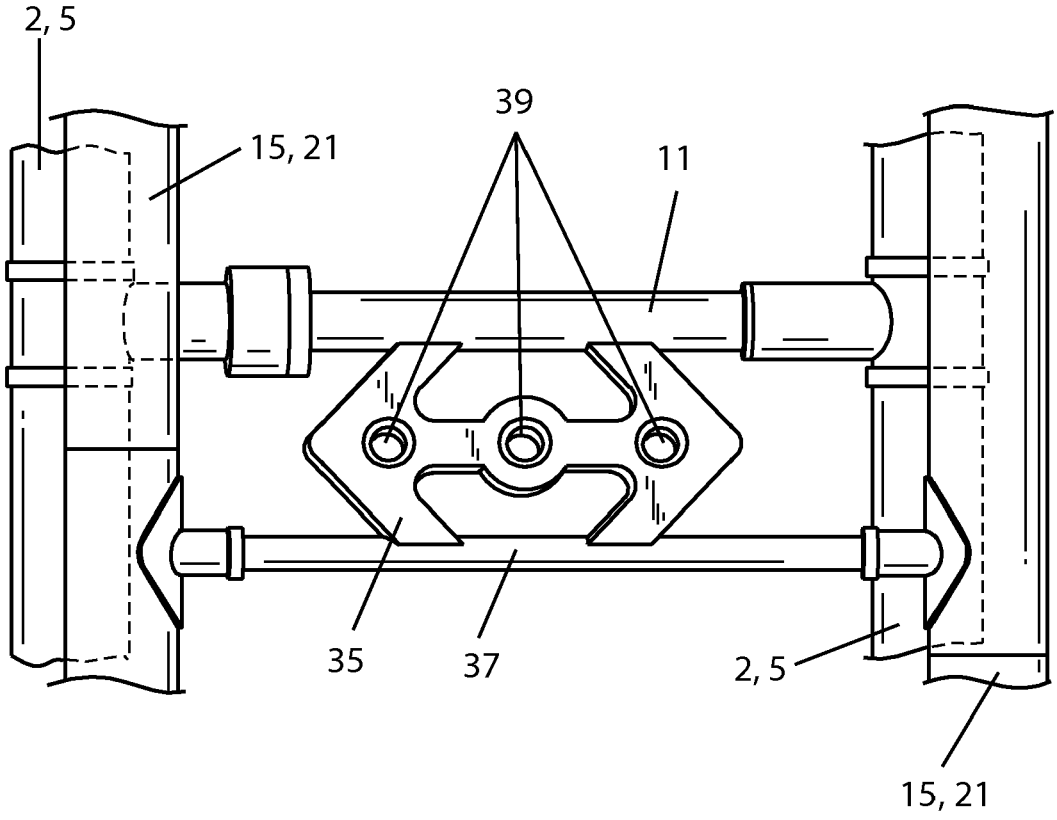
FIG. 3 is a perspective drawing of the inventive cross-brace in the embodiment of FIG. 2.
Figure 4D:
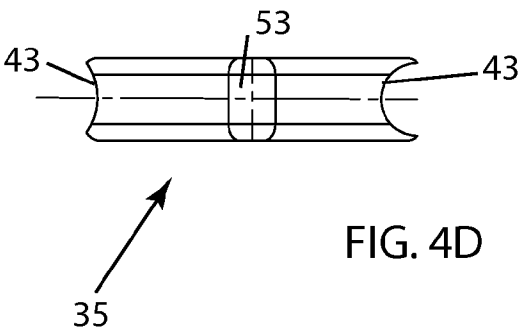
FIGS. 4B, 4C, and 4D are the three orthographic projection views of the inventive cross-brace of FIG. 4A.
Figure 4A:
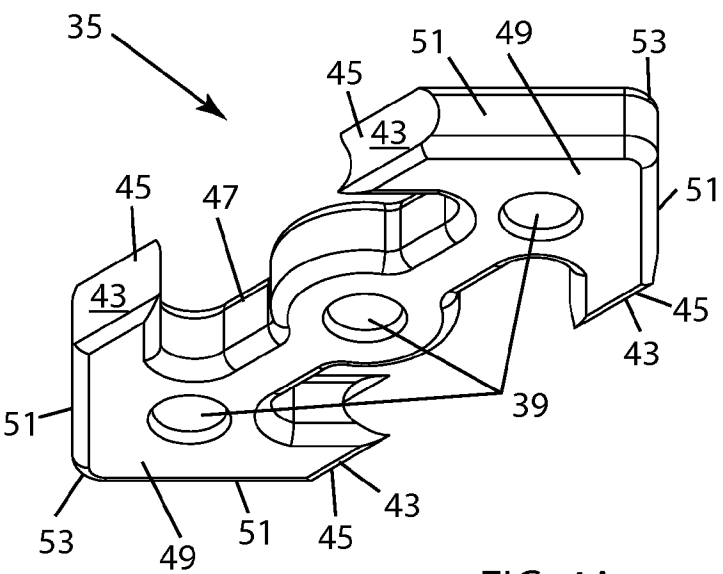
FIG. 4A is a perspective drawing of the inventive cross-brace.
Figure 4C:
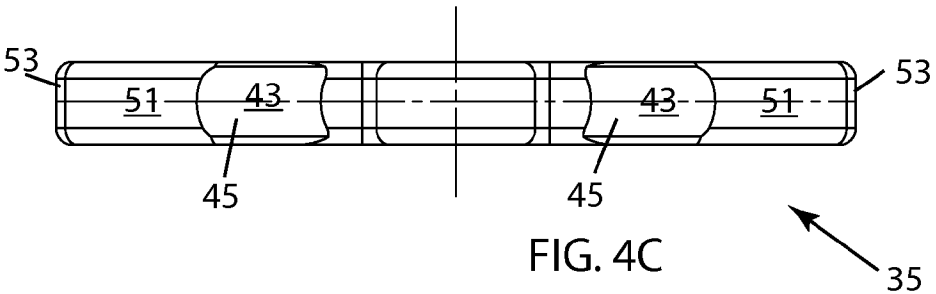
Figure 4B:
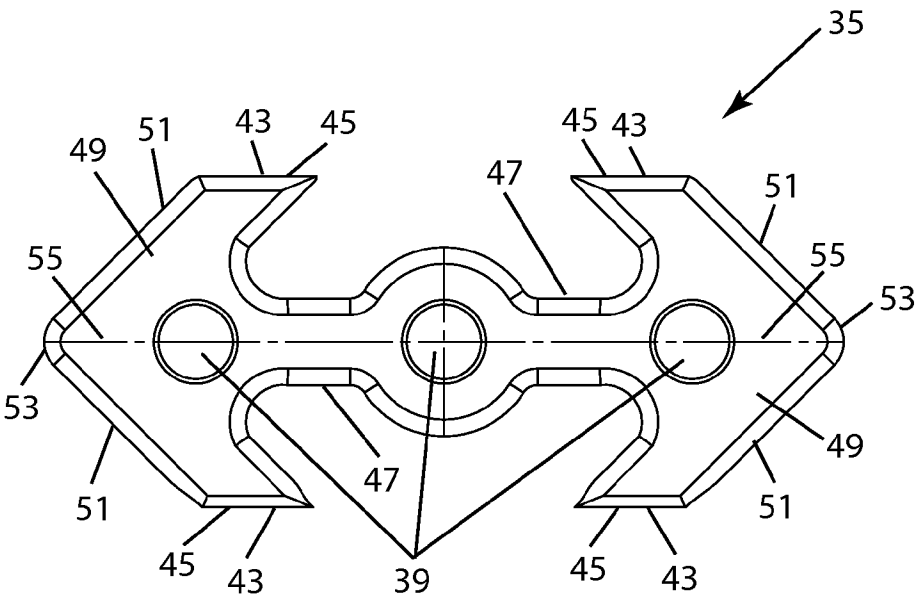

Shown in FIGS. 3 and 4, cross-brace 35 includes three transverse through-holes 39 into which sound-modifying components 41 may be placed. (In FIG. 2, one such sound-modifying component 41 is installed.) It should be noted that cross-brace 35 alone, without the addition of sound-modifying components 41, itself modifies the resonances of trombone 30 in a significant way. In this embodiment of cross-brace 35, which has three transverse through-holes 39, any combination of one, two or three sound-modifying components 41 may be used, depending on the needs of the musician.

Referring again to FIGS. 3 and 4, cross-brace 35 extends in planes substantially parallel to braces 11 and 37 and includes four spaced contact regions 43 along two opposed edges 45. One pair of such spaced contact regions 43, in one of the opposed edges 45, contacts brace 11, and the other pair of spaced contact regions 43, in the other opposed edge 45, contacts brace 37, and these regions of contact provide areas at which structural connections are made with, for example but not limited to, a soldering and/or brazing process, to provide both a strong structural connection as well as a sonic pathway. Cross-brace includes two recessed regions 47 between the pairs of spaced contact regions 43. Each spaced contact region 43 and each recessed region 47 of each opposed edge 45 is in alignment with the corresponding region of the other opposed edge 45.

Also shown in FIGS. 3 and 4, cross-brace 35 also has two opposed end regions 49 which extend beyond a corresponding opposing pair of spaced contact regions 43. Each such end region 49 has a pair of end-edges 51 which converges to a corresponding point region 53. Point regions 53 are along a centerline 55 of cross-brace 35 and are symmetrical to one another.

Figure 5:
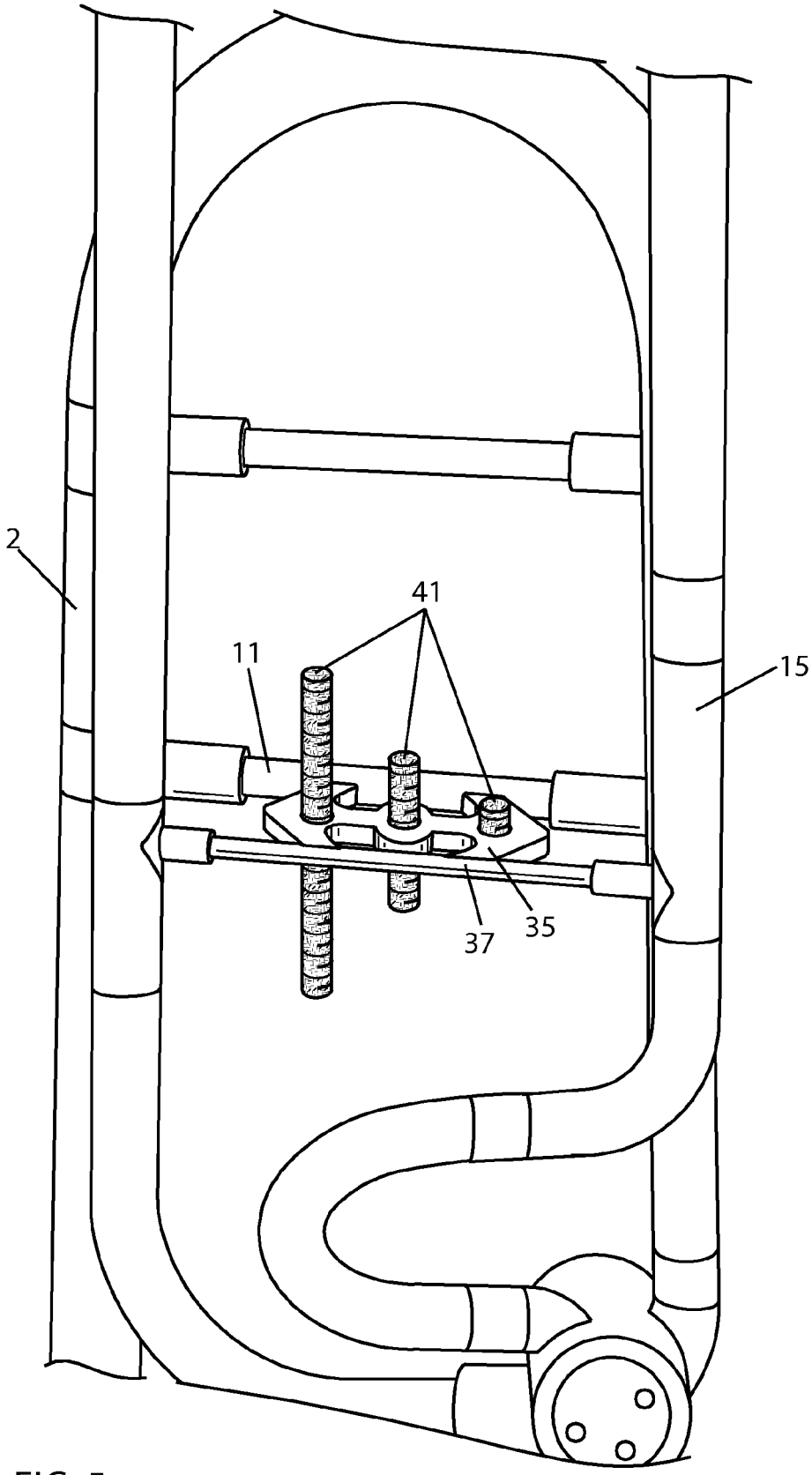
FIG. 5 is a perspective drawing of one embodiment of the inventive cross-brace mounted in the instrument of FIG. 2, the cross-brace having three sound-modifying components (pillars) of various lengths.

FIG. 5 is a perspective drawing of one embodiment of inventive cross-brace 35 mounted in the instrument of FIG. 2. In this embodiment, cross-brace 35 has received three sound-modifying components 41, in this case, pillars 41 of three different lengths. Pillars 41 are mounted in three transverse through-holes 39. Pillars 41 and through-holes 39 are threaded and sized such that pillars 41 are held firmly in place with an interference fit with through-holes 39.

Figure 6:
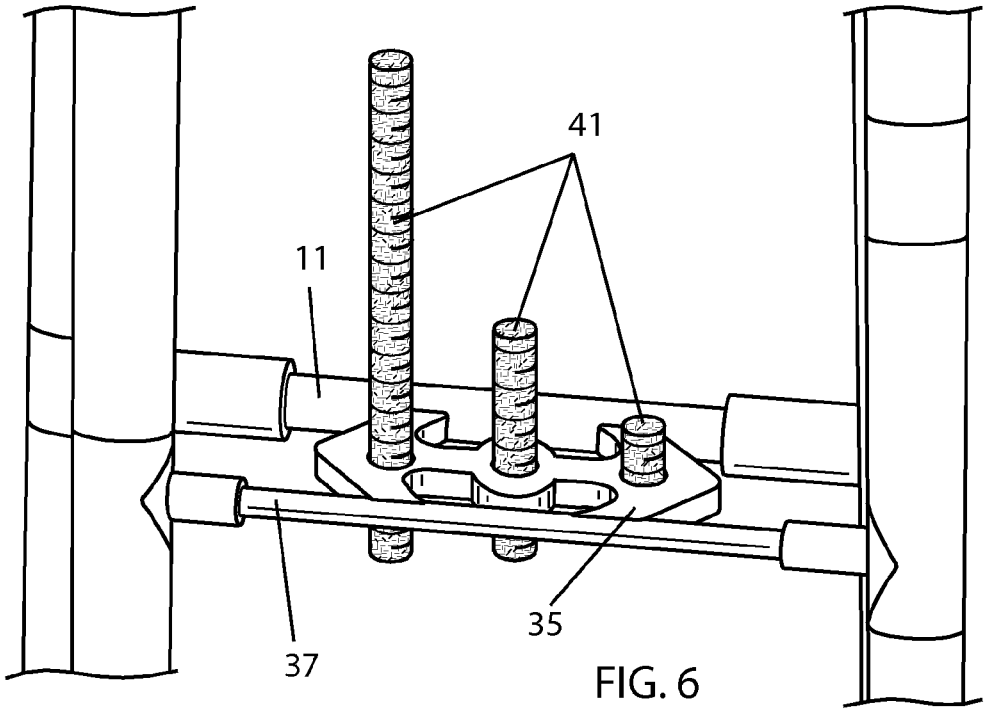
FIGS. 6 and 7 each show a portion of the perspective drawing of FIG. 5 illustrating the sound-modifying components (pillars) adjusted to different lengths in the instrument of FIG. 2.
Figure 7:
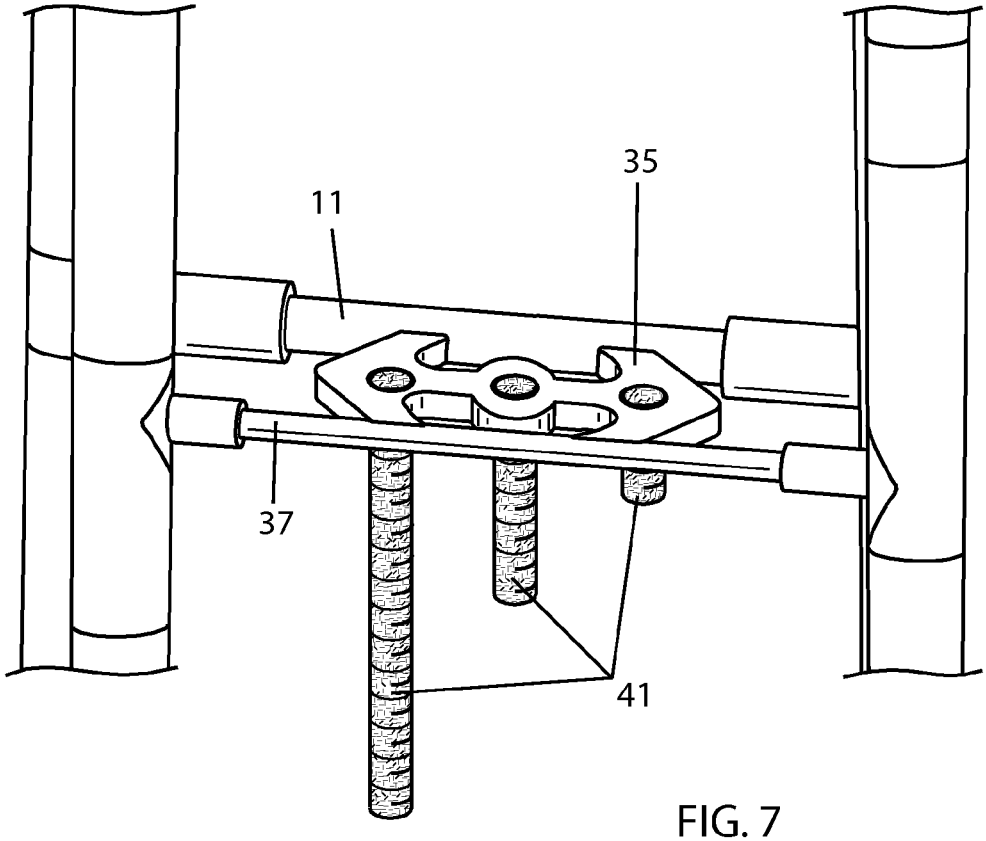

FIGS. 6 and 7 each show a portion of the perspective drawing of FIG. 5, and each figure illustrates sound-modifying components 41 (pillars 41) adjusted to different lengths in trombone 30 to produce different sound quality or "feel" according to the preferences of the musician playing trombone 30.

Figure 8:
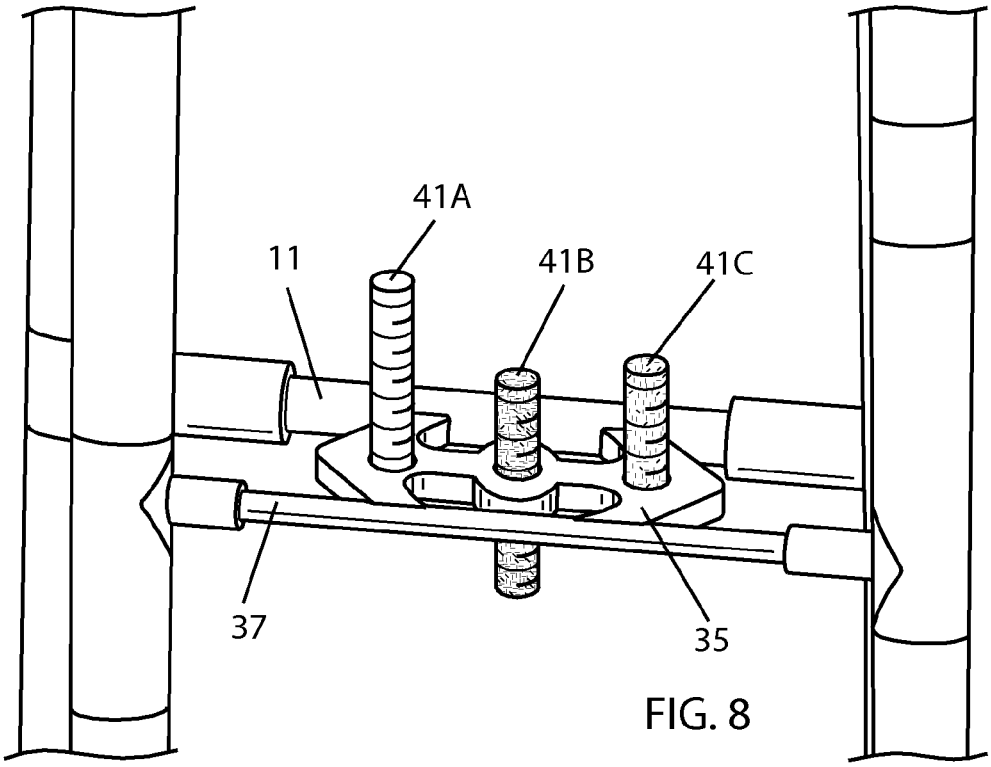
FIGS. 8 and 9 each show a portion of the perspective drawing of FIG. 5 illustrating the sound-modifying components (pillars) made from different materials and adjusted to different lengths in the instrument of FIG. 2.
Figure 9:
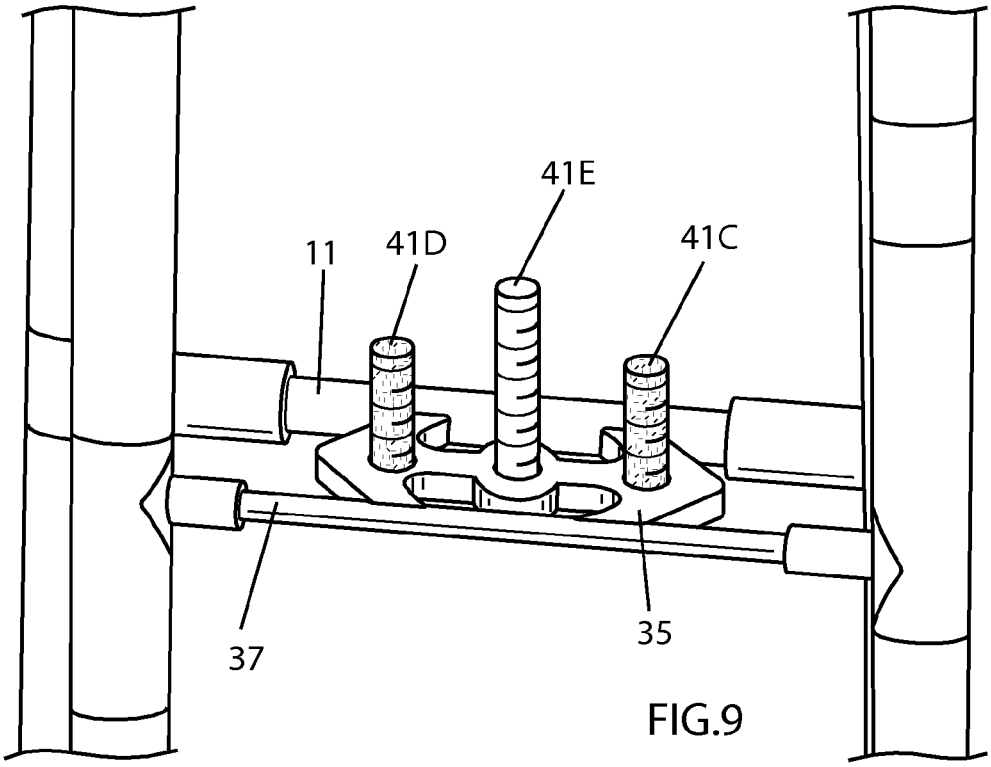
Figure 10:
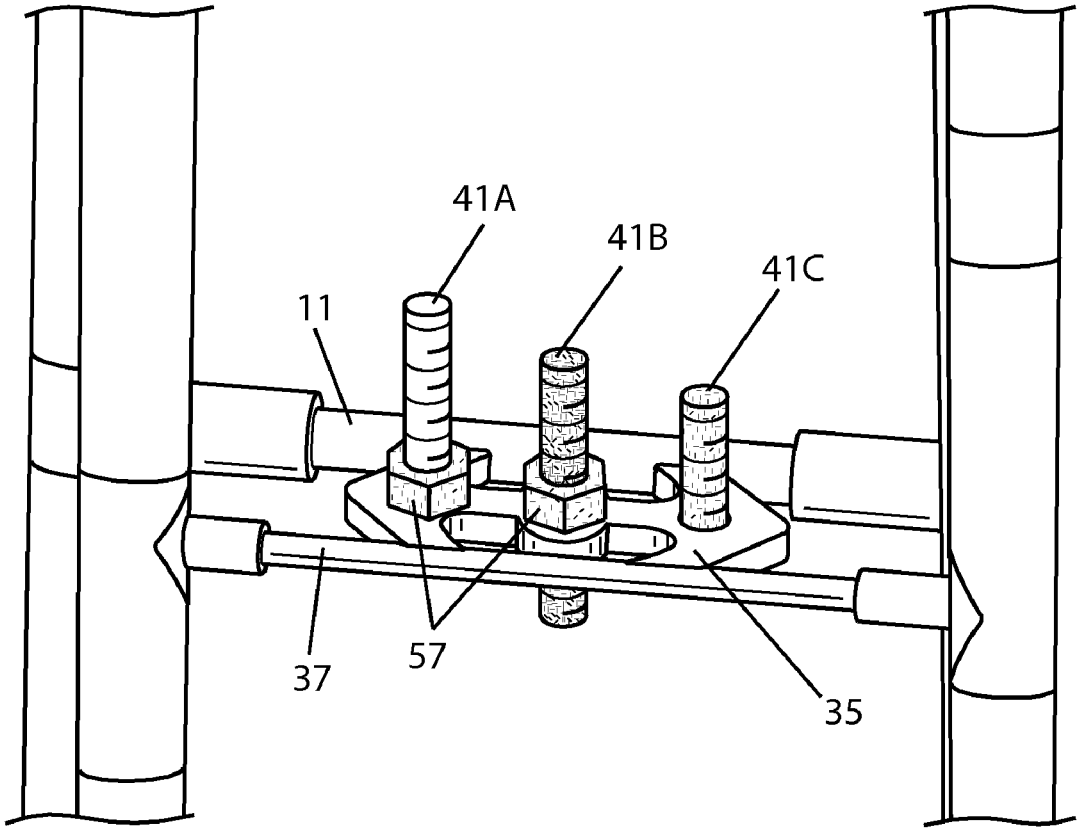
FIG. 10 shows a portion of the perspective drawing of FIG. 5 illustrating the sound-modifying components (pillars) made of different materials, adjusted to different lengths, and including modified pillars as two of the three sound-modifying components in the instrument of FIG. 2. All of the variations of sound-modifying components shown in FIGS. 5-10 vary the sound of the instrument of FIG. 2 according to the needs of a user.

In FIGS. 5-7, pillars 41 are drawn to indicate that the material of which pillars 41 are made is, in this case, copper. In FIGS. 8-10, pillars 41 are drawn and labeled to indicate that different materials are used to fabricate pillars 41. Pillar 41A is made of brass; pillar 41B is copper; pillar 41C is nickel; pillar 41D is nickel; and pillar 41E is brass. In the embodiments illustrated, the sound-modifying components 41 (pillars 41) are all made of metallic materials. However, this is not intended to limit the materials that may be used in any way. Materials such as ceramics, composites, fiber-loaded composites, and wood, have a variety of sonic properties which can be used to modify the sound of the instrument, depending, again, on the needs of the musician. Both the material itself and the hardness of the material, as well as the geometry of the sound-modifying component, affect the resonances of the instrument.

In FIG. 10, sound-modifying components 41A and 41B are modified pillars each including a threaded metallic nut 57 which modifies the sonic properties for pillars 41A and 41B. Nuts 57 may be made of any suitable material and are not limited to being metallic. Nuts 57 provide another "degree-of-freedom" to the adjustment of the performance sound of trombone 30. Nuts 57 are but one example of numerous ways in which the sonic properties of sound-modifying components 41 may be altered. Nuts 57, when tightened, change the internal stresses in pillars 41 and cross-brace 35 which can alter the sonic properties of such components.

All of the variations of sound-modifying components 41 shown in FIGS. 5-10 vary the sound of improved trombone 30 according to the preferences of the musician playing trombone 30.

Figure 11:
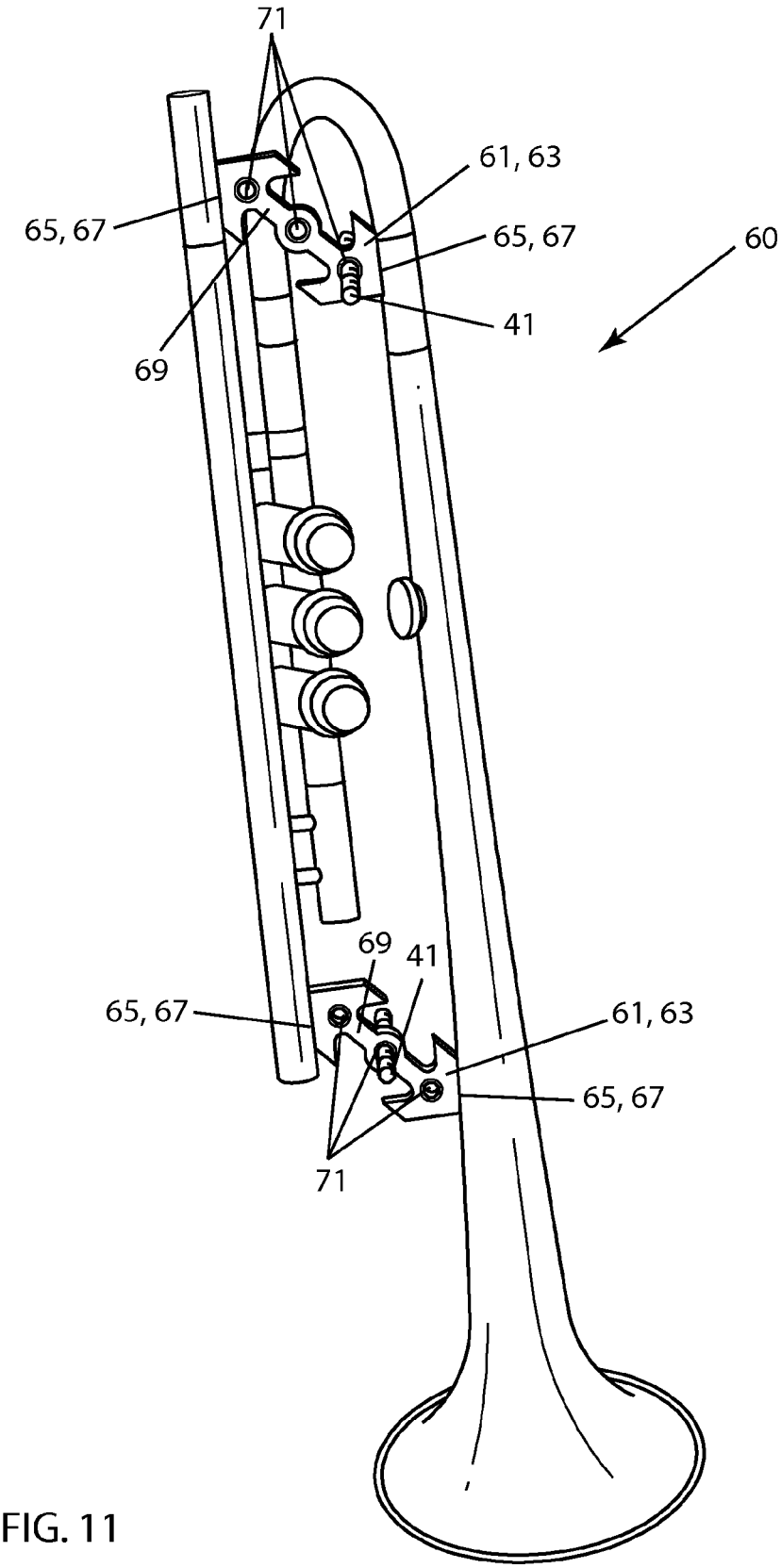
FIG. 11 is perspective drawing of another embodiment of the inventive musical instrument, in this instance a trumpet with two inventive cross-braces spanning between portions of the windpath tubing.

FIG. 11 is a perspective drawing of another embodiment of an improved musical instrument, in this case a trumpet 60 with two braces 61 spanning between portions of the windpath tubing. (In FIG. 11, trumpet 60 has several portions of the windpath tubing removed to more easily illustrate the position of braces 61. The mouthpiece of trumpet 60 is not shown.) In FIG. 11, braces 61 are each a unitary substantially flat metallic body 63 having two edges 65 with contact regions 67 for non-removable attachment to a portion of the brass instrument and a region 69 between contact regions 67 which provides three sites 71 for securement of at least one sound-modifying component. One such sound-modifying component, pillar 41, is shown in FIG. 11.

The use of such bracing provides the musician with even more "degrees-of-freedom" of sound modification by virtue of both brace 61 location and the presence of more transverse through-holes 39 into which sound-modifying components 41 (one shown) may be placed. Braces 61 are in themselves sound-modifying braces.

The embodiment of crossbrace 35 in FIGS. 2-10 extends in planes substantially parallel to a plane of parallel braces 11 and 37 to which crossbrace 35 is secured. Likewise, the embodiments of braces 61 in FIG. 11 have the same physical shape as that of crossbrace 35 but with different regions at which braces 61 are secured to instrument 60, which is in this case trumpet 60. The geometry of braces 61 may differ from the geometry of these embodiments and is not limited to having such a shape. For example, brace 61 could be an existing brace of instrument 60 modified to receive and include a sound-modifying component 41.

Referring now to FIGS. 12A-12H, FIG. 12A is a frequency spectrum of a representative tone from prior art trombone 1. FIGS. 12B through 12H are frequency spectra of representative tones from trombone 30. Each frequency spectrum illustrates relative sound amplitude in decibels (db) as a function of sound frequency. The abscissa of each spectrum is a logarithmic scale of frequency from 10 Hz to 22.5 kHz. The representative tones of each of FIGS. 12A through 12H are the same musical note (same fundamental pitch) played in the same fashion as much as is possible by a trained musician so that comparisons among the spectra are meaningful. FIGS. 12B-12H are intended to illustrate the sound differences that can be achieved between various configurations and not any particular correlation of spectra with any specific configuration of sound-modifying components.

Comments included for each of FIGS. 12A-12H were made by the trained musician who played the representative tones on trombone 30 as configured for each figure as shown. Note that differences in the "feel" of an instrument that may be quite small to the ear of an average listener may in fact be large to the ear of a trained musician and significant to how a musician wishes to present a particular piece of music. Comments made are only a small portion of the comparisons of the sound spectra which can be seen in FIGS. 12A-12H.

Figure 12A:
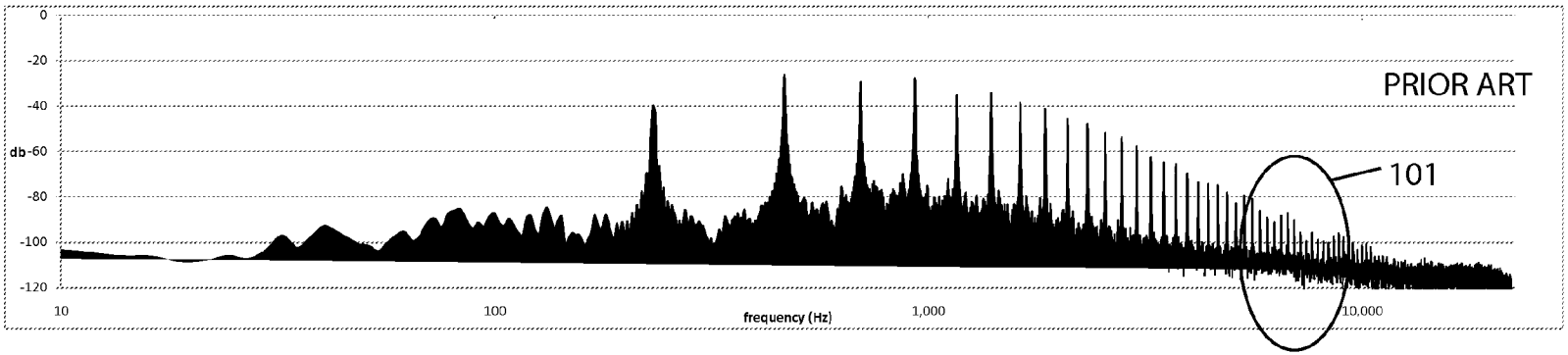
FIG. 12A is a frequency spectrum of a representative tone from a prior art trombone such as that of FIG. 1.
Figure 12B:
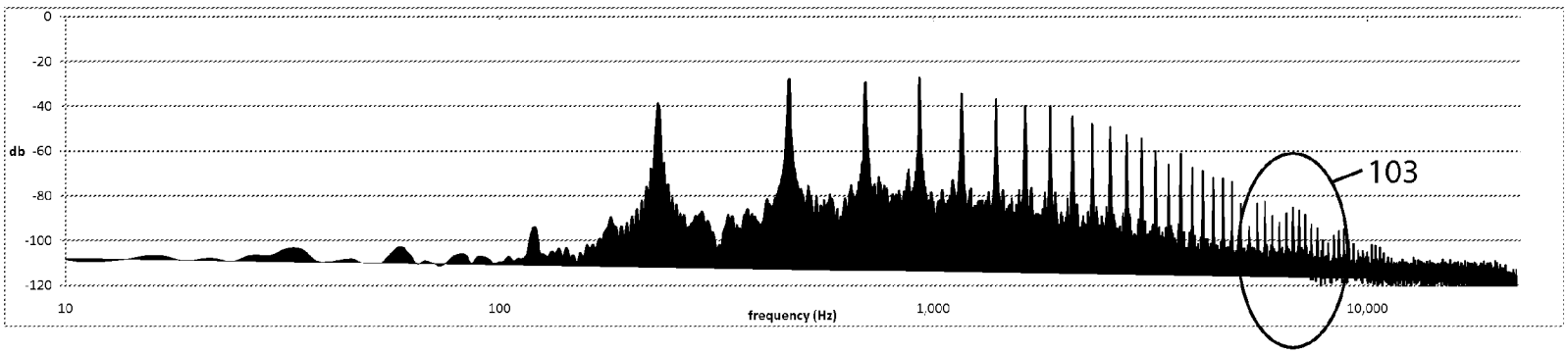
FIGS. 12B through 12H are frequency spectra of representative tones from the improved trombone of FIG. 2.

FIG. 12B is a frequency spectrum of the representative tone played on trombone 30 configured to include cross-brace 35 without any added sound-modifying components. The trained musician stated that the instrument felt more resonant and faster than trombone 1 in FIG. 12A. This difference is at least partially shown as more sound energy in the high mid-range frequencies as indicated by the regions 101 and 103 in FIGS. 12A and 12B, respectively. Region 103 contains relatively more energy in the indicated frequency range than region 101.

Figure 12C:
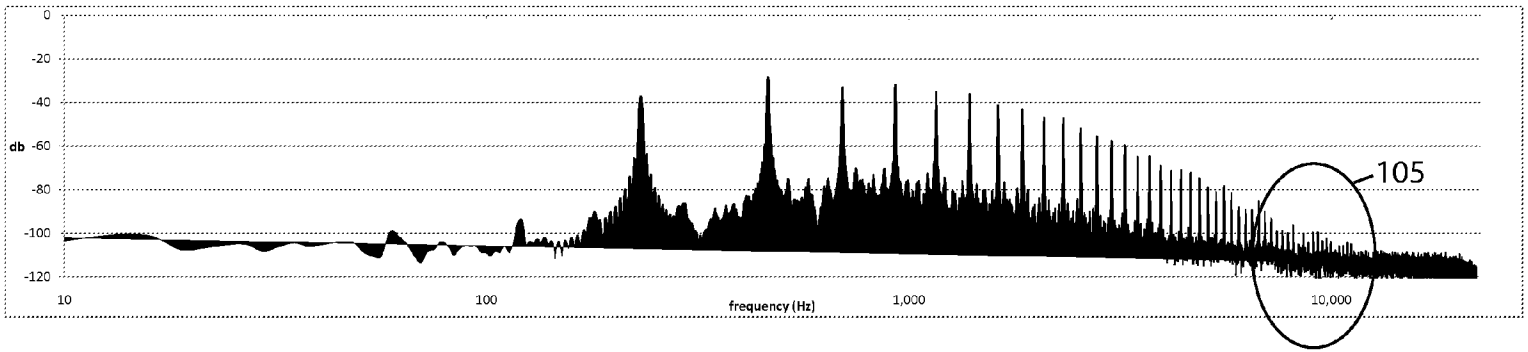
Figure 12D:
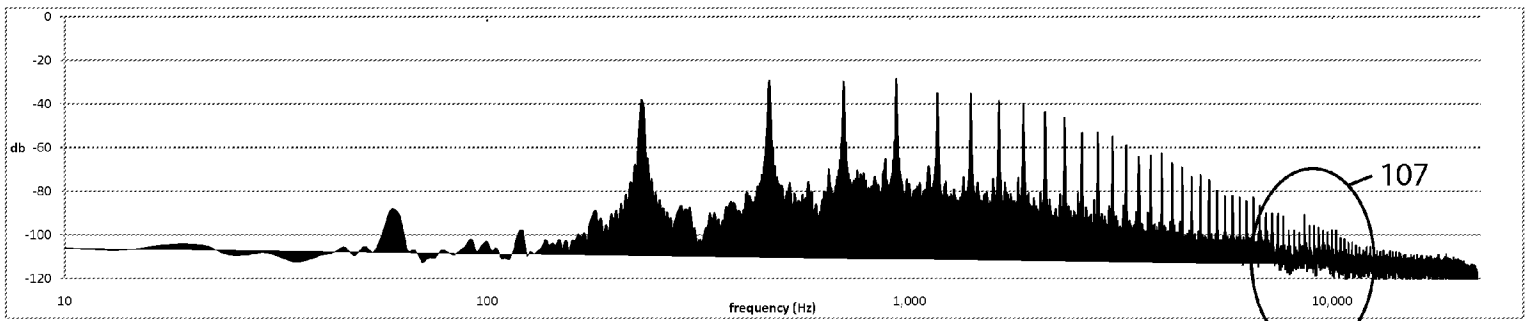

FIG. 12C is a frequency spectrum of the representative tone played on trombone 30 configured to include cross-brace 35 with sound-modifying components configured with three threaded copper pillars 41 of three different lengths. FIG. 12D is a frequency spectrum of the representative tone played on trombone 30 configured to include cross-brace 35 with sound-modifying components configured as for FIG. 12C but with the longest copper pillar 41 adjusted in its through-hole 39. The trained musician stated that the instrument for FIG. 12D felt more "open" and "free-blowing" and sounded more "broad" (less "centered") than the instrument of FIG. 12C. "Broad" indicates relatively more high-frequency overtones, and "centered" indicates relatively fewer high-frequency overtones. These differences are at least partially shown as more sound energy in the frequency range as indicated by the regions 105 and 107 in FIGS. 12C and 12D, respectively. Region 107 contains relatively more energy in the indicated frequency range than region 105.

Figure 12E:
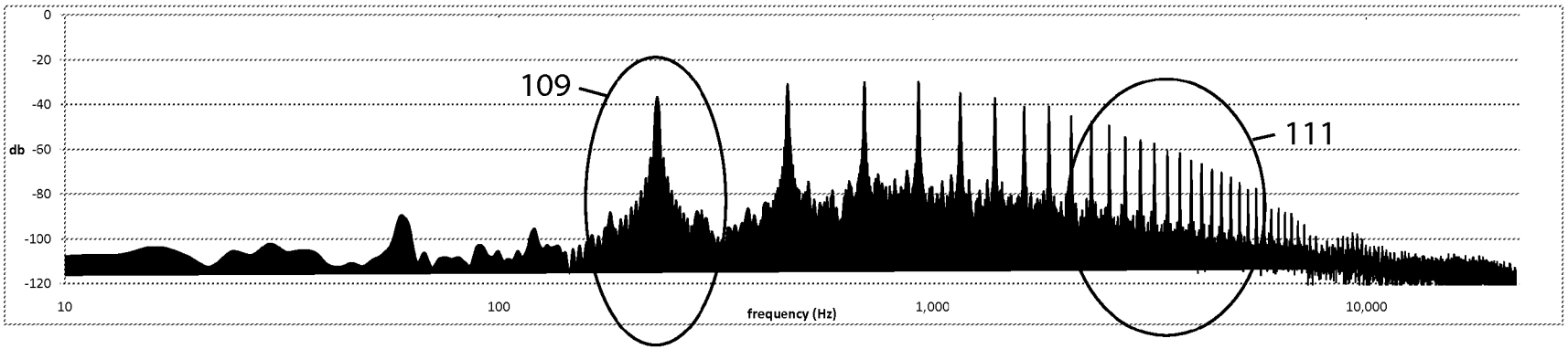
Figure 12F:
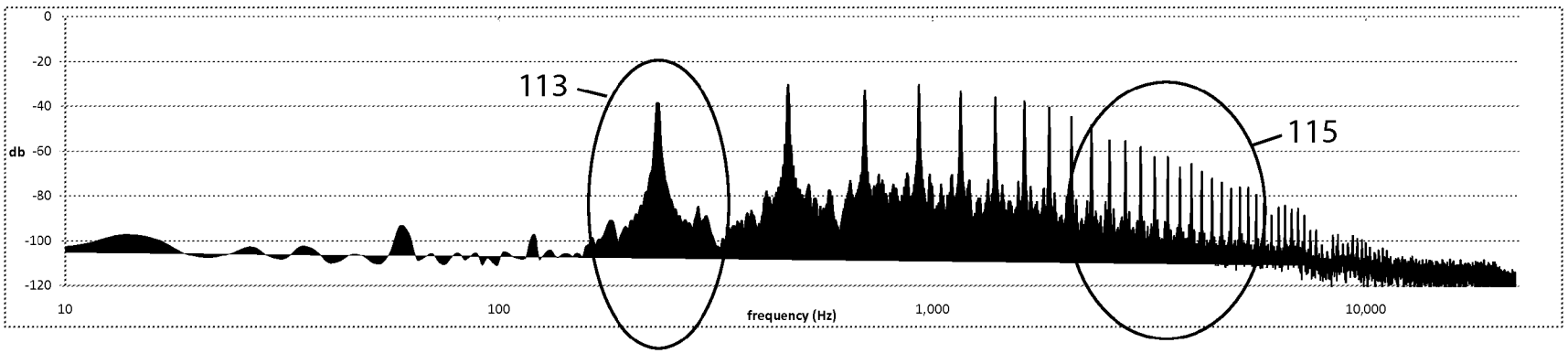

FIG. 12E is a frequency spectrum of the representative tone played on trombone 30 configured to include cross-brace 35 with sound-modifying components configured as for FIG. 12D but with one pillar 41 made of nickel. FIG. 12F is a frequency spectrum of the representative tone played on trombone 30 configured to include cross-brace 35 with sound-modifying components configured with three nickel pillars 41 of different lengths.

In comparing the instruments for FIGS. 12E and 12F, the trained musician stated that the instrument for FIG. 12F felt "smoother" and more transparent at the fundamental frequency (pitch of the note being played) and that the instrument for FIG. 12E felt "wider" with more mid-range overtones. These differences are at least partially shown by comparing regions 109 and 111 in FIG. 12E and regions 113 and 115 in FIG. 12F. In comparing regions 109 and 113, the spectrum in the frequency range around the fundamental frequency in region 113 contains much less energy around the fundamental frequency than region 111. Thus the sound is "smoother" at the fundamental frequency for the instrument for FIG. 12F. A comparison of regions 111 and 115 shows that the instrument for FIG. 12E has more mid-range highs than that for FIG. 12F.

Figure 12G:
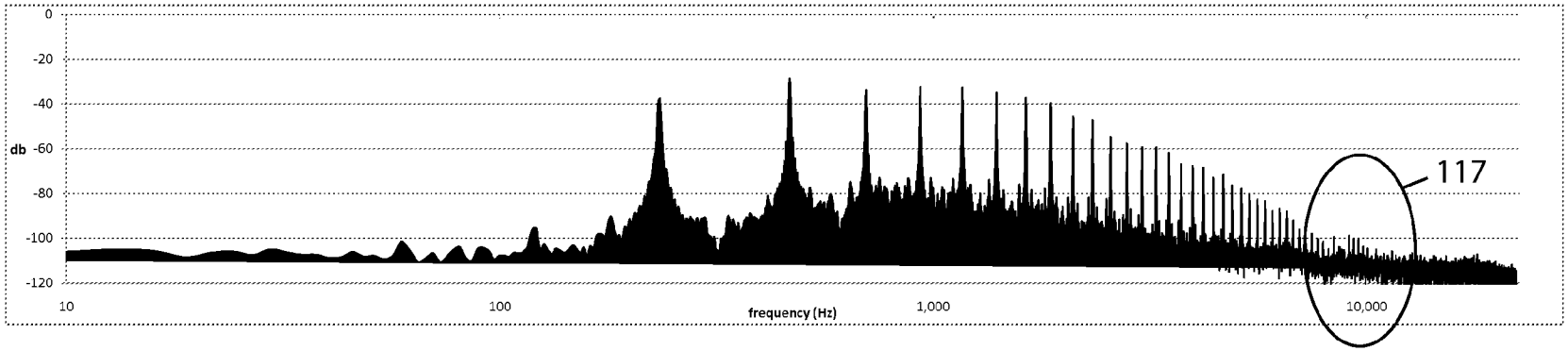
Figure 12H:
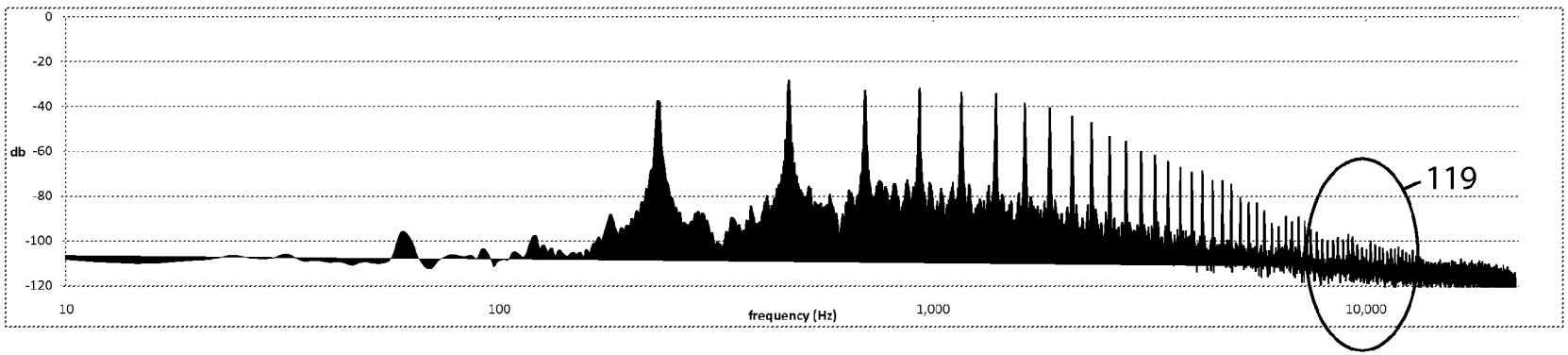

FIG. 12G is a frequency spectrum of the representative tone played on trombone 30 configured to include cross-brace 35 with a single nickel sound-modifying pillar 41. FIG. 12H is a frequency spectrum of the representative tone played on trombone 30 configured to include cross-brace 35 with a single sound-modifying pillar 41 configured identical to that for FIG. 12G but with a copper pillar instead of a nickel pillar. The trained musician stated that the instrument for FIG. 12H felt more "stable" and more "comfortable" than that for FIG. 12G. These differences are at least partially shown by regions 117 and 119 in FIGS. 12G and 12H, respectively. Region 119 shows relatively more energy than in the corresponding frequency range of region 117.

While the principles of this invention have been described in connection with specific embodiments, it should be understood that these descriptions are made only by way of example and are not intended to limit the scope of the invention.

The invention claimed is:

1. In a brass musical instrument having two substantially parallel adjacent braces between portions of the instrument windpath tubing, the improvement comprising a cross-brace extending in planes substantially parallel to a plane of the parallel braces and having two opposed edges each with two spaced contact regions secured to a respective one of the parallel braces and a recessed region between the contact regions, thereby allowing elimination of other windpath bracing and providing at least one site for securement of at least one sound-modifying component.

2. The instrument of claim 1 wherein the cross-brace has at least one through-hole transverse to the planes of the cross-brace, each through-hole being adapted for receiving a sound-modifying component.

3. The instrument of claim 2 further including a sound-modifying component within a through-hole.

4. The instrument of claim 3 wherein the cross-brace has opposed substantially flat faces extending in planes substantially parallel to a plane of the parallel braces with a plurality of the through-holes arranged therealong.

5. The instrument of claim 3 wherein the sound-modifying component is adjustably received within the corresponding through-hole, thereby facilitating sound modification to a musician's preference.

6. The instrument of claim 3 wherein the sound-modifying component is a pillar.

7. The instrument of claim 6 wherein the pillar is adjustably received within the corresponding through-hole, thereby facilitating sound modification to a musician's preference.

8. The instrument of claim 7 wherein the through-hole and at least a portion of the pillar therein are threaded to facilitate adjustability.

9. The instrument of claim 8 wherein the threading provides an interference fit between the pillar and the through-hole.

10. The instrument of claim 1 wherein:

each of the contact and recessed regions of each opposed edge is in alignment with the corresponding region of the other opposed edge; and the cross-brace has opposed end regions each extending beyond a corresponding pair of contact regions.

11. The instrument of claim 10 wherein each end region has a pair of end-edges converging to a point region.

12. The instrument of claim 11 wherein the point regions are along a centerline of the cross-brace and are symmetrical to one another.

13. The instrument of claim 10 wherein the cross-brace has at least one through-hole transverse to the planes of the cross-brace, each through-hole being adapted for receiving a sound-modifying component.

14. A cross-brace for bracing the windpath tubing of a brass musical instrument, the cross-brace comprising a unitary substantially flat metallic body having two opposed edges each with two spaced contact regions for non-removable attachment to a portion of the brass instrument and a recessed region between the contact regions, thereby allowing elimination of other windpath bracing and providing at least one site for securement of at least one sound-modifying component.

15. The cross-brace of claim 14 wherein the body has at least one through-hole transverse thereto, each through-hole being adapted for receiving a sound-modifying component.

16. The cross-brace of claim 15 further comprising a sound-modifying component within a through-hole.

17. The cross-brace of claim 16 wherein the body has a plurality of the through-holes arranged therealong.

18. The cross-brace of claim 16 wherein the sound-modifying component is adjustably received within the corresponding through-hole, thereby facilitating sound modification to a musician's preference.

19. In a brass musical instrument having windpath braces between portions of the instrument windpath tubing, the improvement wherein at least one brace is a unitary substantially flat metallic body having two edges with contact regions for non-removable attachment to a portion of the brass instrument and a region between the contact regions which provides at least one site for securement of at least one sound-modifying component.

20. The instrument of claim 19 wherein the instrument is a trumpet.

21. The instrument of claim 20 further including a pair of such substantially flat braces.

22. In a brass musical instrument having windpath braces between portions of the instrument windpath tubing, the improvement wherein at least one windpath brace is a sound-modifying brace which includes at least one through-hole for adjustable securement of a sound-modifying pillar, a pillar being adjustably secured in such through-holes.

23. The brass musical instrument of claim 22 comprising a plurality of pillars, each secured in a respective through-hole.

* * * * *